United States Patent [19]

Hood et al.

[11] 4,030,439

[45] June 21, 1977

[54] BOOM GOOSENECK FITTING PROVIDING MAINSAIL ROLLER-FURLING

[75] Inventors: Frederick E. Hood; Donald K. Mitchell; Gary S. Uhring, all of Marblehead, Mass.

[73] Assignee: Hood Sailmakers, Inc., Marblehead, Mass.

[22] Filed: Aug. 30, 1976

[21] Appl. No.: 718,949

[52] U.S. Cl. ..... 114/106; 114/90
[51] Int. Cl.[2] ..... B63M 9/04
[58] Field of Search ..... 114/90, 102, 104, 105, 114/106, 107, 112

[56] References Cited

UNITED STATES PATENTS 3,835,804 9/1974 Jackson ..... 114/107

*Primary Examiner*—Trygve M. Blix
*Assistant Examiner*—D. W. Keen
*Attorney, Agent, or Firm*—Kenway & Jenney

[57] ABSTRACT

The gooseneck fitting disclosed herein carries a reel adapted for roll-furling a mainsail along its luff edge, the reel being positioned within a hollow mast with which the gooseneck fitting is used so the mainsail can be rolled up within the mast. The gooseneck fitting incorporates also a sheave for turning a line being drawn horizontally off the reel in a downwardly direction to a point of exit from the gooseneck fitting beneath the boom.

6 Claims, 4 Drawing Figures

BOOM GOOSENECK FITTING PROVIDING MAINSAIL ROLLER-FURLING

BACKGROUND OF THE INVENTION

This invention relates to mainsail roll-furling and more particularly to a boom gooseneck fitting which provides a furling reel interiorly of a hollow mast with which the gooseneck fitting is used so that the mainsail may be rolled up within the mast.

It has been proposed heretofore that mainsails as well as jibs be constructed so as to be roll-furling along their luff edges. Mainsail roll-furling rigs have been constructed in which the mainsail is roll-furled aft of the mast and, more recently, where the mainsail is roll-furled in a tubular compartment within a hollow extruded aluminum mast section. An example of a latter such system is disclosed in U.S. Pat. No. 3,835,804 issued on Sept. 17, 1974 to Patrick T. Jackson of Boothbay Harbor, Maine.

Whether the roll-furling is provided exteriorly or interiorly of the mast, however, it has typically been necessary to mount the rotary drive below the boom, if any boom were used, so as to provide access for the driving means. Further, such prior arrangements were typically quite difficult to install and, once installed, made it relatively difficult to change the mainsail, e.g. from one weight sailcloth to another or to remove the sail, e.g. for repairs.

Among the several objects of the present invention may be noted the provision of mainsail roll-furling apparatus which can be easily installed; the provision of such apparatus which permits a mainsail to be roll-furled within a cavity in a hollow extruded aluminum mast section, the mainsail being drawn out through an aft-facing slot in the mainsail; the provision of such apparatus which provides easy control of the roll-furling apparatus from a convenient point of access; the provision of such apparatus which facilitates the changing of sails; the provision of such apparatus which is relatively free from any tendency to jam or bind; and the provision of such apparatus which is reliable and which is of relatively simple and inexpensive construction. Other objects and features will be in part apparent and in part pointed out hereinafter.

SUMMARY OF THE INVENTION

A gooseneck fitting constructed in accordance with the present invention is adapted for use with a mainsail which is roller-furling on its luff edge so as to be self-storing within a hollow mast, the mast having an aft-facing slot through which the mainsail may be drawn. The gooseneck fitting itself involves a curved plate adapted to conform to the cross-section of the mast at the lower end of the mainsail slot. A reel for furling the mainsail is rotatably mounted in bearings on the pair inward side of the plate. On the opposite side of the plate from the reel is a hinge or swivel means for mounting a boom and also a sheave for turning a line being drawn horizontally off the reel downwardly to a point of exit from the fitting beneath the boom.

DESCRIPTION OF THE PREFERRED EMBODIMENT

Figure 1:
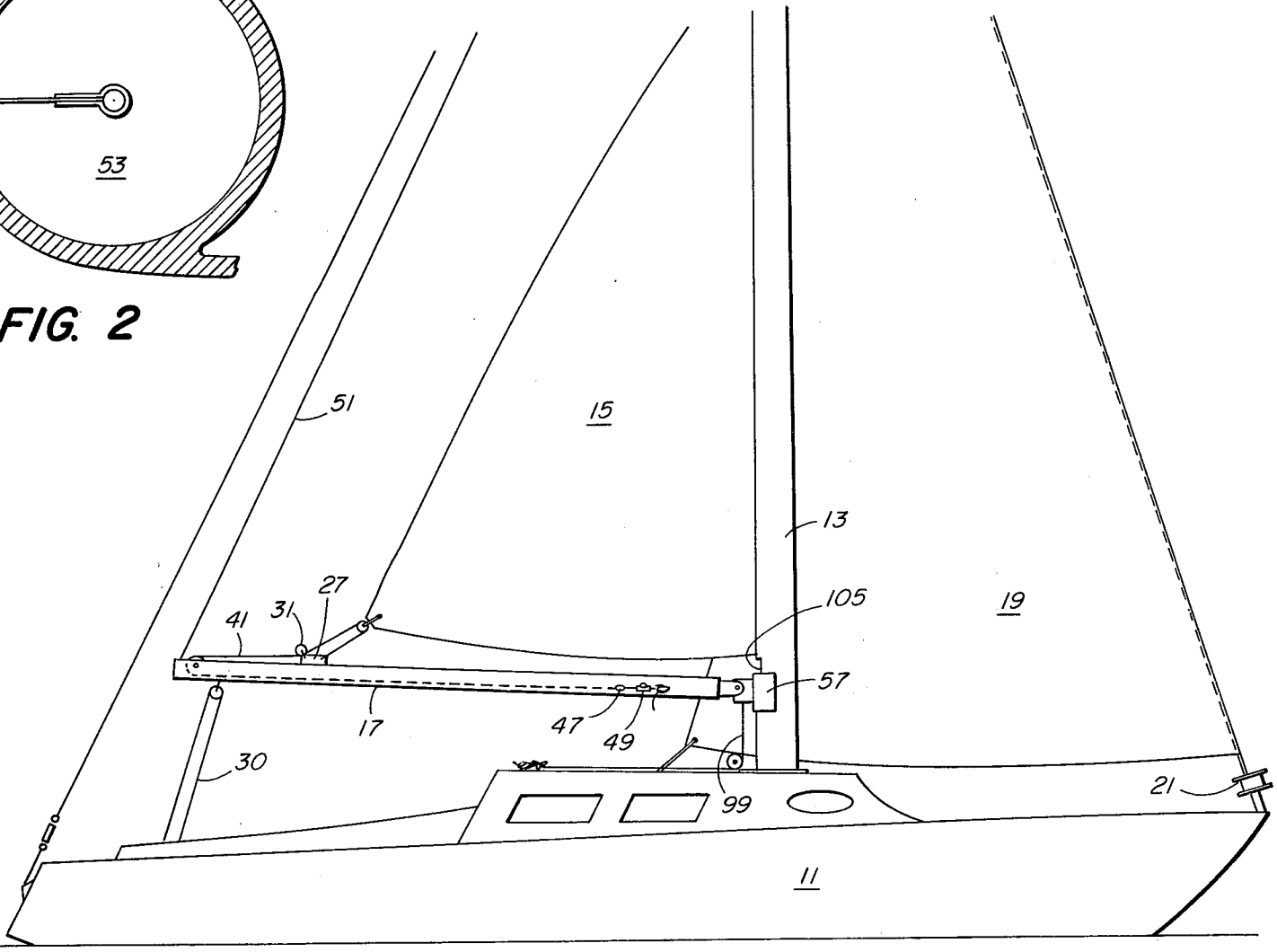
FIG. 1 is a side view of a cruising type auxiliary sailboat having a roll-furling mainsail, the roller-furling apparatus being incorporated into a gooseneck fitting constructed in accordance with the present invention.

Referring now to FIG. 1, there is indicated at 11 the hull of a cruising type auxiliary sailboat having a conventionally stayed mast adapted for internal mainsail furling, e.g. as described in the previously mentioned Jackson U.S. Pat. No. 3,835,804. As described in that patent, the mainsail roller furls along its luff edge within a compartment in the mast and exits from that compartment through an aft-facing slot. The mainsail, designated 15, is loosefooted and is trimmed to a boom 17.

In particular, the clew of the mainsail 15 is secured to a car which is freely slidable along the length of the boom. The car, designated 23, is of a construction which is essentially conventional for travellers and the like, e.g. employing roller-bearing wheels adapted to roll along a track integrally extruded with the boom 17. The car 23 carries a first block 31 while a second block 33 is attached to the clew 35 of the mainsail 15.

Figure 2:
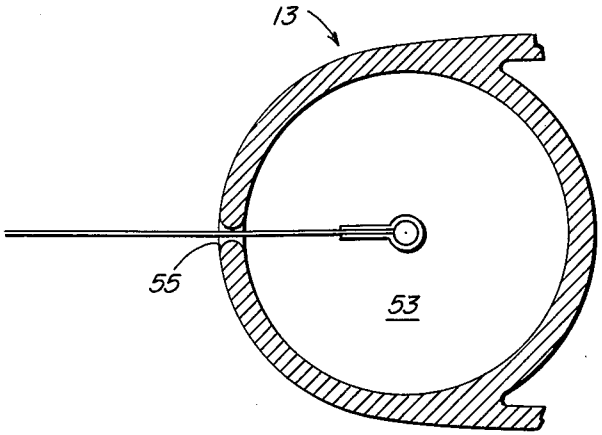
FIG. 2 is a side view, to enlarged scale with parts broken away, of the gooseneck fitting of FIG. 1.

An outhaul line 41 is rigged to pull aft from the tip of the boom by means of a sheave 43 journaled at the boom tip. From the sheave 43, the outhaul line 41 passes forward and through the block 31 on the car 23, thence through the block 33 on the clew of the sail and then back to the car 23 where it is secured, e.g. by a shackle as indicated at 45. For ease in adjustment, the control end of the outhaul line 41 is preferably led forward inside the boom as shown in FIG. 2 to a feed-through 47 and a cleat 49 where it may be adjustably secured. Preferably, the boom 17 is also provided with a topping lift, indicated at 51 in FIG. 1, which is fed over a second sheave mounted parallel to the outhaul sheave 43, the topping lift then also being led forward inside the boom where it may be conveniently secured near the gooseneck.

An advantage of this form of rigging for the mainsail clew is that the position of the car 23 does not have to be independently controlled in a manner which would require additional control lines. Rather, the car 23 is freely slidable along the boom and is acted upon by a balance of forces which urge the car to a position automatically providing an appropriate drawing angle for shaping the mainsail.

The boat is also provided with a jib 19 and, in order to provide the maximum flexibility in ease of setting and furling sail area, this jib is preferably also provided with conventional jib furling gear, as indicated diagrammatically at 21.

As will be understood from the general proportions of FIG. 1, the mainsail is, in that drawing, shown in a substantially furled position, i.e. with the working area of the said substantially reduced. Such a partially furled attitude might be suitable for sailing in quite heavy winds. Under lighter wind conditions, however, the outhaul line can be tightened while letting off of the roller-furling apparatus.

Figure 4:
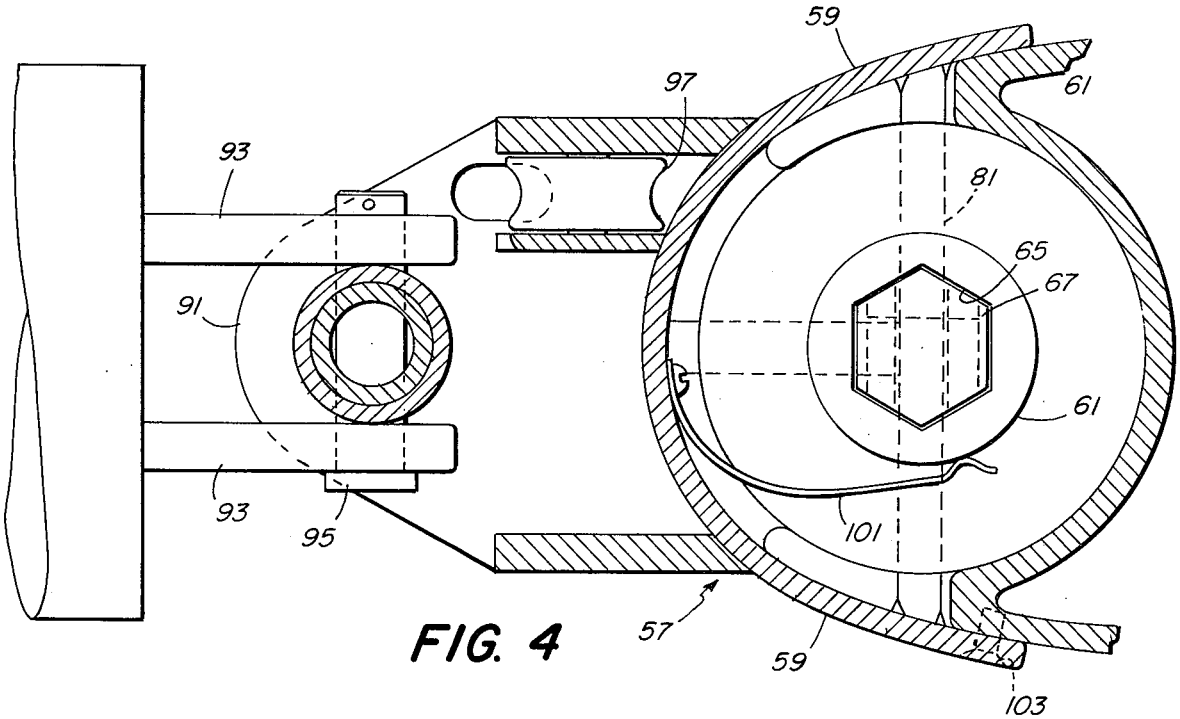
FIG. 4 is a top sectional view, taken substantially on the line 4—4 of FIG. 2, showing the gooseneck fitting. Corresponding reference characters indicate corresponding parts throughout the several views of the drawings.
Figure 3:
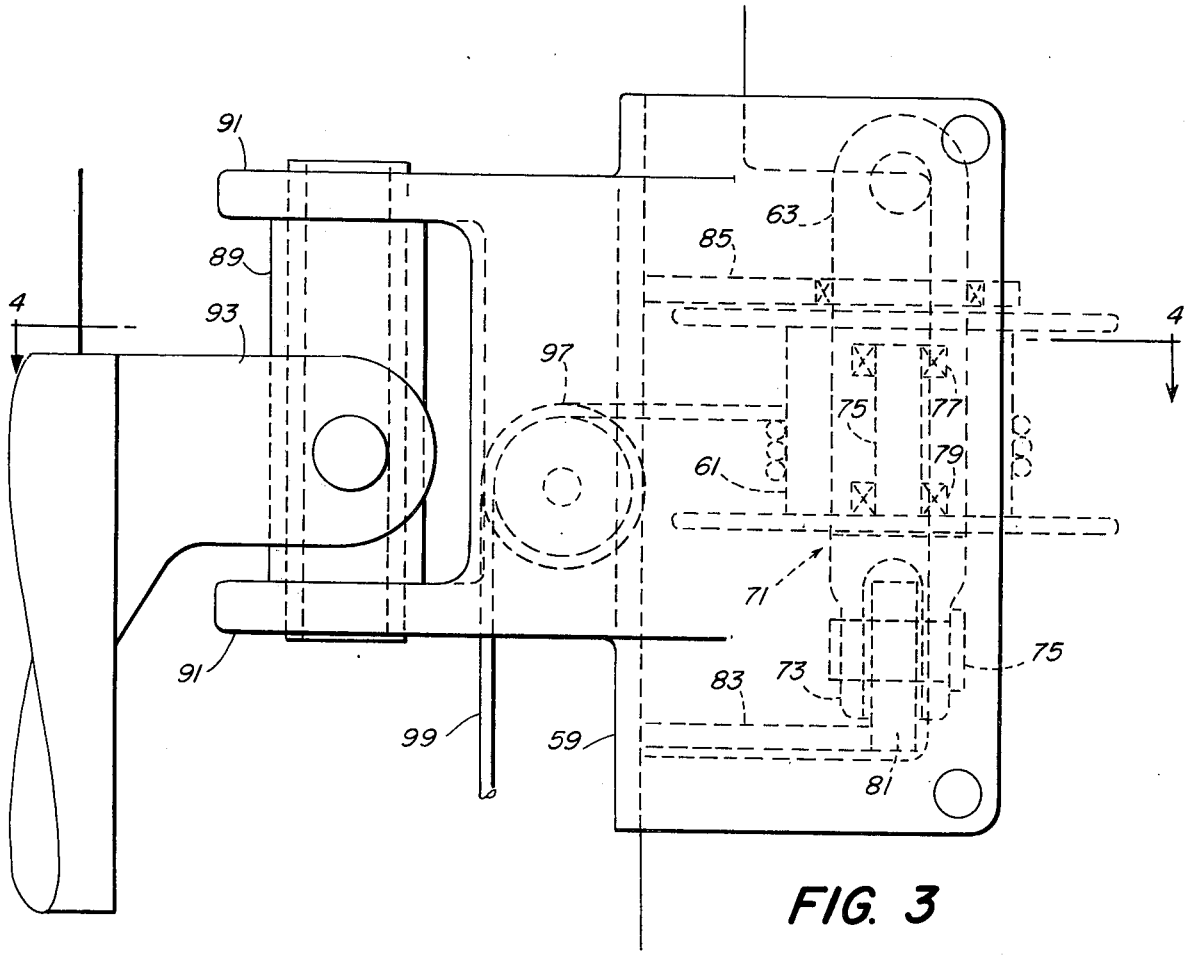
FIG. 3 is a top sectional view, taken substantially on the line 3—3 of FIG. 1, showing the mast cross-section.

In accordance with the present invention, the roller-furling apparatus itself is incorporated into the gooseneck fitting for the boom which is used to trim the mainsail. As may be seen in FIG. 3, the mast 13 is an extruded aluminum section providing a generally cylindrical sailreceiving cavity 53 with an aft-facing slot 55. With reference to FIGS. 2 and 4, the gooseneck fitting, designated generally by reference character 57, includes a curved plate 59 which conforms to the rear peripheral curvature of the mast cross section of the mast extrusion so as to facilitate the mounting of the gooseneck fitting on the aft side of the mast at the appropriate height. On its inward side, i.e. the mast side, the curved plate 59 carries a drum or reel 61 which is the actual means for accomplishing or generating the roller-furling action.

The drum 61 has a hexagonal inner opening 65 which fits over and engages for rotation with the outer housing 67 of a swivel assembly designated generally as 71.

The swivel housing 67 carries at its upper end the clevis 63 to which the lower end of the mainsail is attached. The lower end of the swivel assembly 71 terminates in a similar clevis 73 which is carried on the end of a central stem or rod 75 journaled within the housing 67 by means of bearings 77 and 79. A flat bar 81 extending from side to side of the curved brad 89 forms a bracket on which the lower clevis 73 is secured by means of a pin 75. Flexure of the bar 81 is further controlled by a welded brace 83 extending aft to the curved plate 59.

While the bar 81 absorbs tension inserted on the swivel assembly by the mainsail luff, an apertured plate 85 is provided which acts as a guide for the upper end of the swivel. Since this guide does not take any of the tension loading from the luff of the mainsail, it may be constructed of a suitable plastic such as delrin whereas the other portions of the gooseneck fitting are cast or constructed of aluminum plate components assembled by heliarc (TIG) welding.

The side of the curved plate 59 carries a hinge or swivel means for mounting the boom 17. In the embodiment illustrated, this swivel means comprises a vertical hollow shaft 89 rotatably mounted between a pair of lugs 91 extending aft from the plate 59. The boom carries a pair of smaller, forward-extending lugs 93 which pass on either side of the shaft 89 and are secured thereto by a horizontal pin 95 which permits the boom to rise while pivoting motion of the vertical shaft 89 allows the boom to swing laterally for adjusting the trim of the mainsail 15.

The gooseneck fitting 57 also carries a sheave 97. This sheave is oriented so as to turn a line being drawn horizontally off the reel 61 downwardly so that it exits the gooseneck fitting beneath the boom. The curved plate 59 is itself apertured so that the line, designated 99 can pass therethrough.

In order to cause the line 99 to build up smoothly on the reel 61 when the mainsail is being drawn out through the slot 55, e.g. by tensioning the outhaul line 41, a flat spring guard or wiper 101 is provided which provides friction and holds the line against the center of the reel. With this spring guard or wiper, a wire rope can be used for the line 99 which provides a considerable space saving as compared with rope, i.e. consistent with the use of a relatively small reel no larger than the cross-section of the sail-storing cavity 53.

As will be appreciated from the foregoing description and understanding of the drawings, the present invention provides a unitary assembly which may be easily installed on the mast and which incorporates both the boom gooseneck and the roller-furling apparatus while avoiding any conflict or obstruction of one element by the other. The assembly is relatively easily installed by securing the curved plate 59 to the mast 13 itself, e.g. by screws as indicated at 103. As may be seen in the drawings, the cutout 105 in the mast 13 is extended above the area covered by the curved plate 59 so as to provide an opening through which the mainsail can be initially introduced and through which attachment can be made to the clevis 63. Since the roller-furling line 99 exits near the gooseneck swivel and the outhaul line can be brought forward internally in the boom, it can be seen that all adjustments required for changing the degree of exposure of the mainsail may be conveniently made from one point. This point may be either near the gooseneck itself or in the alternative both lines may be led from points near the gooseneck aft to a convenient place of operation near the bulkhead near the rear of the cabin top as shown in FIG. 1.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A roller-furling mainsail rig comprising: A mast having a generally cylindrical sail-receiving compartment and an aft-facing slot through which the mainsail may be drawn from said compartment;
   - a curved plate conforming to the rear peripheral curvature of the mast cross-section at the lower end of the mainsail slot;
   - a reel for furling the main sail;
   - a bracket on the inward side of said plate for rotatably supporting said reel within the mast, said mast being apertured near its base to receive said reel when the plate is mounted to the mast;
   - a boom provided with means for securing the clew of the mainsail; and
   - hinge means for mounting said boom on the opposite side of said plate from said reel whereby by mounting said plate on said mast, said roller-furling reel and said boom are in co-operative relationship.

2. A roller-furling mainsail rig as set forth in claim 1 wherein said mast is also apertured just above the mounting position of said plate to facilitate initial introduction of a mainsail into said compartment and securing of the lower end of the mainsail luff to said reel.

3. A roller-furling mainsail rig as set forth in claim 1 further including a sheave for turning a line being drawn horizontally off said reel downwardly to a point of exit beneath the boom.

4. A roller-furling mainsail rig as set forth in claim 1 further including spring-biased wiping means for retaining, in closely coiled form, a line being wound on said reel.

5. A gooseneck fitting for a boom adapted for use with a mainsail which is roll-furling on its luff edge so as to be self-storing within a hollow mast, the mast having an aft-facing slot through which the mainsail may be drawn, said fitting comprising:

A curved plate conforming to the cross-section of the mast at the lower end of the mainsail slot;
a reel for furling the mainsail;
a bracket on the inward side of said plate for rotatably supporting said reel within the mast;
hinge means on the opposite side of said plate from said reel for mounting a boom; and
a sheave for turning a line being drawn horizontally off said reel downwardly to a point of exit from said fitting beneath the boom.

6. A gooseneck fitting as set forth in claim 5 further including spring-biased wiping means for retaining, in closely coiled form, a line being wound on said reel.

* * * * *